United States Patent [19]

Feldman

[11] Patent Number: 4,657,740

[45] Date of Patent: Apr. 14, 1987

[54] METHOD OF SCAVENGING OXYGEN FROM AQUEOUS MEDIUMS

[75] Inventor: Nancy A. Feldman, Philadelphia, Pa.

[73] Assignee: Betz Laboratories, Inc., Trevose, Pa.

[21] Appl. No.: 673,693

[22] Filed: Nov. 21, 1984

[51] Int. Cl.[4] ..... C23F 11/06

[52] U.S. Cl. ..... 422/13; 252/390; 210/750; 422/16

[58] Field of Search ..... 422/11, 13, 16; 210/749, 750; 252/180, 390

[56] References Cited

U.S. PATENT DOCUMENTS 2,580,924 1/1952 Jacoby ..... 422/16
3,029,125 4/1962 Hummel ..... 422/16
3,378,581 4/1968 Hummel ..... 422/16
4,019,859 4/1977 Lavin et al. ..... 422/16

*Primary Examiner*—Barry S. Richman
*Assistant Examiner*—William R. Johnson
*Attorney, Agent, or Firm*—Alexander D. Ricci; Bruce E. Peacock

[57] ABSTRACT

Methods for chemically scavenging oxygen from an aqueous medium comprising the addition of linear, water soluble polyethyleneamines, such as tetraethylenepentamine and triethylenetetramine, as the sole oxygen scavenger, to the desired aqueous medium. Suitable environments for use of these amines comprise boiler feedwater and boiler steam condensate systems.

9 Claims, No Drawings

METHOD OF SCAVENGING OXYGEN FROM AQUEOUS MEDIUMS

FIELD OF THE INVENTION

The present invention pertains to methods for reducing dissolved oxygen in aqueous mediums and elevating system pH by the use of linear, water soluble polyethyleneamines.

BACKGROUND

From a corrosion point of view, the presence of dissolved gases, even in small amounts, is undesirable in water systems which contact metal surfaces. For example, metal surfaces in contact with oxygen-containing industrial water can experience severe pitting. Pitting is highly concentrated corrosion affecting only a small area of the total metal surfaces. This can, however, be a serious problem causing metal failure even though only a small amount of metal is lost and the overall corrosion rate is relatively low.

With respect to oxygen, the severity of attack will depend on the concentration of dissolved oxygen in the water, water pH and temperature. As water temperature increases, as for example in a water heating system, enough driving force is added to the corrosion reaction that small amounts of dissolved oxygen in the water can cause serious problems. Oxygen pitting is considered to be a most serious problem in boiler systems, even where only trace amounts of oxygen are present.

Deaeration is a widely used method for removing oxygen from an oxygen-containing aqueous medium. It is particularly useful for treating boiler feedwater and can be either mechanical or chemical.

While vacuum deaeration has proven to be a useful mechanical deaeration method for treating water distributing systems, boiler feedwater is treated using pressure deaeration with steam as the purge gas. According to the pressure deaeration method for preparing boiler feedwater, the water is sprayed into a steam atmosphere and is heated to a temperature at which the solubility of oxygen in the water is low. About 95 to 99 percent of the oxygen in the feedwater is released to the steam and is purged from the system by venting.

Mechanical deaeration is considered an important first step in removing dissolved oxygen from boiler feedwater. However, as already noted, as water temperature increases, even trace amounts of dissolved oxygen can cause serious problems. Accordingly, supplemental chemical deaeration is often required.

Traditional chemical oxygen scavengers include sodium sulfite and hydrazine. However, sodium sulfite cannot be safely utilized in boiler systems operating at above about 1000–1500 psi as corrosive hydrogen sulfide and sulfur dioxide can be formed at pressures above this range. Also, at these pressures, dissolved solids from the sulfite-oxygen reaction product can become a significant problem.

Hydrazine is a toxic substance and is thought to be carcinogenic. Hence, its use is undesirable.

U.S. Pat. Nos. 4,282,111, (Ciuba) and 4,278,635 (Kerst) both disclose the use of hydroquinone, per se, as effective boiler water oxygen scavengers. As an improvement over the use of hydroquinone by itself, it was surprisingly discovered that only certain amines were compatible with hydroquinone. These amines were described as muamines and are disclosed in U.S. Pat. Nos. 4,289,645 and 4,279,767 (of common assignment herewith). The combined use of such hydroquinonemu-amine combinations is highly advantageous since the product can be marketed in a single drum and since this product not only performs the highly valuable oxygen scavenging function but also elevates condensate system pH so as to inhibit troublesome carbonic acid based corrosion. One such compatible mu-amine is triethylenetetramine (a linear, water soluble polyethyleneamine).

U.S. Pat. No. 2,580,923 (Jacoby) discloses the use of certain amine salts to prevent corrosion in boilers. Specifically discussed are: morpholine, cyclohexylamine, monoethanolamine, benzylamine and dimethylethanolamine. Further, hydroxylamine, and derivatives thereof have been proposed in U.S. Pat. No. 4,067,690 (Cuisia) as being effective oxygen scavengers. U.S. Pat. No. 4,019,859 (Lavin et al) discloses the combination of triethylenetetramine and alkali metal sulfite or bisulfite oxygen scavenger. In accordance with the Lavin et al disclosure, this specific amine is used to stabilize the alkali metal sulfite or bisulfite solutions.

Despite the numerous prior art approaches to oxygen scavenging and steam condensate system neutralization, the provision of a single compound or group of compounds capable of providing both the scavenging and neutralizing functions is highly desirable from a commercial point of view. Such dual functionality would solve the problem of having to blend the oxygen scavenger compound with a separate neutralizing amine.

DETAILED DESCRIPTION

These and other problems encountered in various prior art approaches are thought minimized by the present invention, to wit, use of linear, water soluble polyethyleneamines and/or water soluble salt forms thereof to effectively scavenge oxygen from desired aqueous mediums. At the same time these amines act to elevate system pH so as to inhibit, in boiler condensate systems, the deleterious effect of carbonic acid formation therein.

The linear water soluble polyethyleneamines of the present invention have the formula $$NH_2(CH_2CH_2NH)_xH$$

wherein x is greater than 1 and is preferably 2 to about 10. The following polyethyleneamines are mentioned as being exemplary:

diethylenetriamine
triethylenetetramine
tetraethylenepentamine
pentaethylenehexamine It is to be understood that water soluble salt forms of these amines are also within the ambit of the invention.

Based upon presently available experimental data, it is preferred to use tetraethylenepentamine.

The above amines are to be used in the desired system as the sole oxygen scavenger therein. Accordingly, my invention does not cover utilization of the above polyethyleneamines with other oxygen scavengers such as hydroquinone, or sulfite or bisulfite compounds.

The linear water soluble polyethyleneamines may be added to any aqueous medium for which protection against oxygen based corrosion and/or pH elevation is desired. Within the boiler environment, they may be directly added to either the boiler feedwater or steam condensate system.

The amount of polyethyleneamine added could vary over a wide range and would depend on such known factors as the nature and severity of tne problem being treated. It is thought that the minimum amount of polyethyleneamine could be about 1 part per million parts of aqueous medium being treated. The preferred minimum is about 50 parts per million. It is believed that the polyethyleneamine scavenger could be fed as high as about 2,000 parts per million, with about 1,000 parts per million being the preferred maximum.

The linear water soluble polyethyleneamines of the invention did not scavenge oxygen under room temperature conditions. However, as shown in the following examples, these materials do scavenge oxygen at temperature and pressure conditions which are representative of actual boiler usage.

In treating boiler feedwater, it is preferred that once the water reaches the boiler proper, it has an alkaline pH, which is always the case for boilers operating within the ASME guidelines. Such condition is easily met by use of the polyethyleneamines of the present invention.

In treating boiler feedwater, it is a well known fact that oxygen can get into the boiler from other sources. Accordingly, in keeping with standard practices, an excess amount of the polyethyleneamine oxygen scavenger should be used to provide a residual amount thereof in the boiler water for the uptake of oxygen from other sources.

The invention will be further illustrated by the following examples which are included as being illustrative of the invention and which should not be construed as limiting the scope thereof.

EXAMPLES

In order to demonstrate efficacy of the linear polyethyleneamine oxygen scavengers of the present invention, oxygen scavenging tests were conducted under conditions of elevated temperature and pressure. The test apparatus used was essentially a stainless steel hot water flow system equipped with appropriate monitoring instrumentation. Demineralized feedwater, adjusted to the appropriate initial dissolved oxygen level (controlled by nitrogen sparging), was pumped from a reservoir at ambient temperature into a once-through heater. Temperature was monitored continuously by means of thermocouples at several locations along the length of the flow tubing. A solution containing the oxygen scavenger test material was loaded into a pump driven syringe and fed continuously to the heated flow stream through a port. The feedwater containing dissolved oxygen and the test material then traversed the flow tubing via a by-pass comprising an additional length of coiled tubing. Contact (or reaction) time of the test material and dissolved oxygen was governed by the choice of coil length and flow rate. The tendency of the temperature to drop during residence in the coiled tubing was offset by the use of thermostatted heating tapes which maintained the temperature in this tubing at about 190° F. Upon exiting the coiled tubing, the stream flowed through a sample cooler to render the temperature of the liquid compatible with the operating range of a membrane-type dissolved oxygen probe. The cooled liquid was analyzed for dissolved oxygen via a D.O. flow cell, and pH was potentiometrically monitored in the flow tube immediately downstream of the D.O. probe. Outputs of the temperature, pH and dissolved oxygen probes during operation were monitored via strip chart recorders. The final destination of the reaction mixture was a reservoir which could be drained for analysis of reaction products, if desired.

A suitable set of operating conditions were found which were not extremely different from those experienced in boiler feedwater systems and which did not result in experimental uncertainties. A flow rate of 275 mL/min. through the apparatus was chosen, since this yielded the optimum response of the dissolved oxygen probe. Temperature in the system could be maintained at 190°±5° F. under 14±1 psig. Residence time of the feedwater in the flow tube from chemical feed point to D.O. flow cell outlet was 4±0.2 minutes. Approximately 3.5 minutes of this total was spent in a 40' length of 0.402 inch i.d. coiled tubing. Entry into and residence in the sample cooler accounted for 0.5 minute of the total contact time.

The results obtained are reported in Table 1.

TABLE I

| Material | Stock Solution Concentration | Feedwater Concentration (ppm Actives) | Reaction pH | Initial Oxygen (ppb) | Final Oxygen (ppb) | % Removal |
|---|---|---|---|---|---|---|
| TETA | 20% | 82 | 10.3 | 525 ± 5 | 245 | 53 ± 1 |
| TETA | 20% | 87 | 10.3 | 510 ± 10 | 250 | 51 ± 1 |
| TEPA | 20% | 1000 | 11.3 | 480 | 5 | 99 |
| TEPA | 20% | 116 | 10.4 | 480 | 215 | 55 |

TETA = triethylenetetramine
TEPA = tetraethylenepentamine

In order to determine the activity of the polyethyleneamine oxygen scavengers of the present invention at low treatment levels, additional tests were performed using the apparatus hereinabove described. Results and reaction conditions are reported in Table 2.

TABLE 2

| Compound | Treatment Level (ppm) | % $O_2$ Removal | Reaction pH |
|---|---|---|---|
| Tetraethylenepentamine | 5.7 | 12 ± 1 | 9.6 |
| Tetraethylenepentamine | 10.4 | 19 ± 1 | 10.0 |
| Tetraethylenepentamine | 22.5 | 44 ± 1 | 10.2 |
| Triethylenetetramine | 4.7 | 19 ± 1 | 9.5 |
| Triethylenetetramine | 7.7 | 25 ± 2 | 9.8 |
| Triethylenetetramine | 17.2 | 47 ± 2 | 10.1 |
| Diethylenetriamine | 2.9 | 5 ± 1 | 9.5 |
| Diethylenetriamine | 6.3 | 6 ± 1 | 9.8 |
| Diethylenetriamine | 12.0 | 10 ± 1 | 10.0 |
| Diethylenetriamine | 18.5 | 18 ± 2 | 10.2 |
| Hydroquinone | 0.61 | 95 ± 6 | 9.7 |
| Hydroquinone | 8.1 | 95 ± 4 | 9.7 |
| Hydroquinone | 19.2 | 95 ± 2 | 9.7 |

Conditions
62 PPB $O_2$ (Initial)
18–20 PSIG
4 minute reaction time
195 F

While the invention has been described hereinabove with respect to specific embodiments of same, such are not intended to limit the scope of the invention. The invention is intended to cover any equivalents, modifications, etc., and is to be limited solely by the scope of the appended claims.

I claim:

1. A method for reducing the amount of oxygen in an oxygen containing aqueous medium comprising adding to said aqueous medium, as the sole oxygen scavenger, an oxygen scavenging amount of a polyethyleneamine solution comprising a member selected from the group consisting of tetraethylenepentamine, and triethylenetetramine or water soluble salt forms or mixtures thereof.

2. A method as recited in claim 1 wherein said aqueous medium comprises feedwater to a boiler.

3. A method as recited in claim 1 wherein said aqueous medium comprises condesnsed steam in a boiler condensate system.

4. A method as recited in claim 1 wherein said member is tetraethylenepentamine.

5. A method as recited in claim 1 wherein said member is triethylenetetramine.

6. A method as recited in claim 1 wherein said polyethyleneamine solution is added in an amount of between 1 to about 2,000 parts of said polyethyleneamine based upon one million parts of said aqueous medium.

7. A method as recited in claim 6 wherein said polyethyleneamine solution is added in an amount of between 50 to about 1,000 parts based upon one million parts of said aqueous medium.

8. A method as recited in claim 1 wherein said aqueous medium has a alkaline pH.

9. A method as recited in claim 8 wherein said pH is about 8 or greater.

* * * * *